United States Patent [19]

Winter et al.

[11] 3,942,063

[45] Mar. 2, 1976

[54] INCANDESCENT LAMP HAVING INCREASED LIFE

[75] Inventors: Frederik Nicolaas Winter; Wilhelmus Martinus Jozef Van Gils, both of Eindhoven, Netherlands

[73] Assignee: U.S. Philips Corporation, New York, N.Y.

[22] Filed: Jan. 10, 1974

[21] Appl. No.: 432,282

[30] Foreign Application Priority Data

Feb. 14, 1973 Netherlands ..... 7302046

[52] U.S. Cl. ..... 313/315; 313/344

[51] Int. Cl.[2] ..... H01K 1/14

[58] Field of Search ..... 313/271, 315, 316, 333, 313/344, 37, 39, 42

[56] References Cited

UNITED STATES PATENTS

| | | | |
|---|---|---|---|
| 1,998,958 | 4/1935 | Flaws, Jr. | 313/333 |
| 2,084,999 | 6/1937 | Birdseye | 313/315 |
| 2,424,518 | 7/1947 | Stuart | 313/344 |
| 2,479,193 | 8/1949 | Zabel | 313/344 |

*Primary Examiner*—Edward S. Bauer
*Assistant Examiner*—Wm. H. Punter
*Attorney, Agent, or Firm*—Frank R. Trifari

[57] ABSTRACT

The invention relates to a normal incandescent lamp having a coiled filament throughout its length, whose secondary winding in a turn near the ends of the filament secured to the current supply wires exhibits a larger pitch than the winding of the central part of the filament.

3 Claims, 3 Drawing Figures

INCANDESCENT LAMP HAVING INCREASED LIFE

Figure 1:
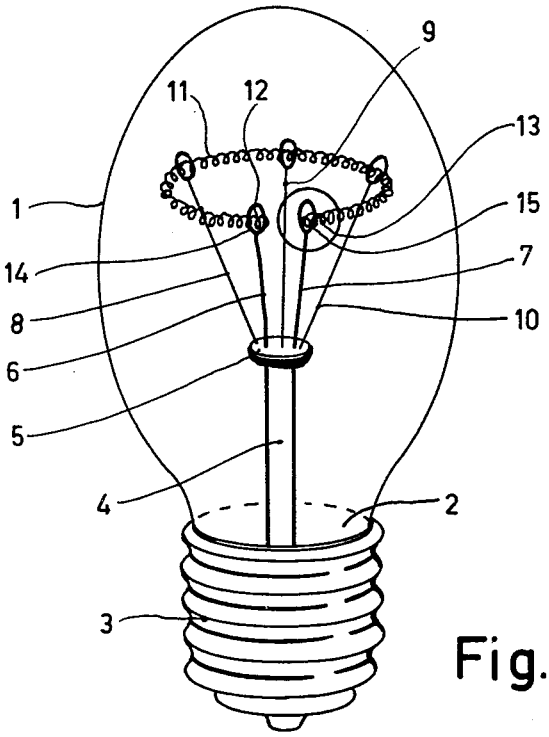

The invention relates to a normal incandescent lamp which comprises a coiled coil filament which is arranged in a lamp envelope and whose end portions are each secured to a current supply wire. Such a normal incandescent lamp is known.

It is known in incandescent lamp technology that the life of an incandescent lamp is also determined by the number of filament turns which effectively contribute to the luminous efficiency of the incandescent lamp. It is therefore necessary that the number of effective turns after assembly of the filament to the current supply wires be equal to the prescribed number. For that purpose the distance between the ends of the current supply wires to which the filament is secured should be adjusted with great accuracy. Distance is to be understood to mean herein the distance measured along the filament.

When, however, a filament which is helically wound with a continuous pitch throughout its length is used, said requirement of accuracy is very high because in the type of filament conventionally used in normal incandescent lamps, the quantity of filament wire per unit of length of the filament is large, also near the places where the filament is secured to the current supply wires. For example, such a filament for a normal incandescent lamp of 60 Watt and 220/230 Volt comprises approximately 28 mm of filament wire per mm of length of filament, and such a filament for a normal incandescent lamp of 60 Watt and 110 Volt comprises approximately 36 mm of filament wire per mm of length of filament. In a mechanized manufacture of normal incandescent lamps having a filament which is wound helically throughout its length with a continuous pitch it therefore appears that the filament of many lamps does not comprise the required number of effective turns.

In order to obtain the desired reproducibility of the number of effective turns in the manufacture, a coiled coil filament is therefore frequently used nowadays, which filament comprises two singular coiled stretched end portions which are secured to the current supply wires. The quantity of filament wire per unit of length in the stretched end portions is approximately one-fifth of the quantity of filament wire per unit of length in the coiled coil part. As a result of this the influence of a deviation in the prescribed distance between the current supply wires is smaller than in the above-mentioned type of filament.

The connection of the filament to the current supply wire is a clamping connection, the end of the current supply wire opening into the lamp vessel being bent while clamping one of these stretched end portions. Because, however, the end portions are formed from only a single-coiled wire, said end portions are very thin so that such an end portion can easily work loose from the clamping, which results inter alia in a reject in the production. In order to avoid said working loose, the bent end of the current supply wire is usually flattened.

Although a filament which comprises stretched end portions and has the correct number of secondary windings can be manufactured by using a suitable winding machine, a drawback is, however, that during the manufacture of the stretched end portions the winding head of such a machine should each time stop in a prescribed position while the winding mandril is moved. As a result of said regular stopping of the winding head the production speed is rather low.

It is the object of the invention to provide a normal incandescent lamp in the manufacture of which this drawback does not occur.

Therefore, according to the invention, the normal incandescent lamp which comprises a coiled coil filament which is arranged in a lamp envelope and whose end portions are each secured to a current supply wire is characterized in that in each of the zones of the filament adjoining said end portions at least one turn occurs in the secondary winding thereof whose pitch is larger than the pitch of the secondary winding in the central part of the filament present between said zones.

In the operating condition of said incandescent lamp, the filament at the area of the turn having the larger pitch exhibits a large temperature gradient so that only the turns of the central part of the filament contribute effectively to the luminous efficiency of the lamp. The end portions secured to the current supply wire are formed from a coiled coil wire and have a diameter which is equal to the diameter of the central part of the filament. As a result of this, the possibility of an end portion working loose from the bent end of the current supply wire is very small. Therefore, the bent end of the current supply wire in the normal incandescent lamp according to the invention need not be flat.

Because a turn in the said zones comprises less filament wire than a turn in the central part of the filament, a deviation of the prescribed distance between the current supply wires in the normal incandescent lamp according to the invention has a smaller influence on the life of the lamp than is the case with a filament having a pitch which is the same throughout its length.

Upon winding the filament used in the normal incandescent lamp according to the invention, the winding having the larger pitch can suitably be carried out in three manners:

1. By temporarily braking the winding head of the winding machine to a lower speed, the transit rate of the winding mandril being maintained constant.

2. By temporarily increasing the transit rate of the winding mandril with the speed of the winding head remaining the same.

3. By using an auxiliary finger which is temporarily held between the turns. Combinations of these methods are also possible.

So the winding head need not be braked to the stationary position.

A favourable embodiment of the normal incandescent lamp according to the invention is characterized in that the pitch of the secondary winding of each of the end portions of the filament is smaller than or equal to the pitch of the secondary winding in the adjacent zone and is larger than or equal to the pitch of the secondary winding of the central part of the filament. According as the pitch of the secondary winding of the end portions is larger, a higher production rate can be achieved but on the other hand, according as said pitch is smaller, the quantity of wire material clamped in the bent end of the current supply wire will be larger so that the quality of the connection of the filament to the current supply wires is better.

A further favourable embodiment of the normal incandescent lamp according to the invention is characterized in that the pitch of the secondary winding in the zones adjoining the end portions is at least 2 times but at most 4 times as large as the pitch of the secondary winding in the central part of the filament. It has been found that, when the value of the pitch of the secondary winding in said zones is chosen to be between said values, a good marking is formed between the winding of the central part contributing effectively to the luminous efficiency and the end portions.

Figure 2:
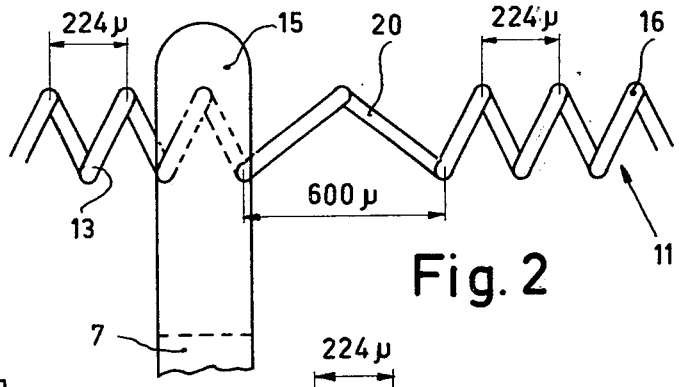
Figure 3:
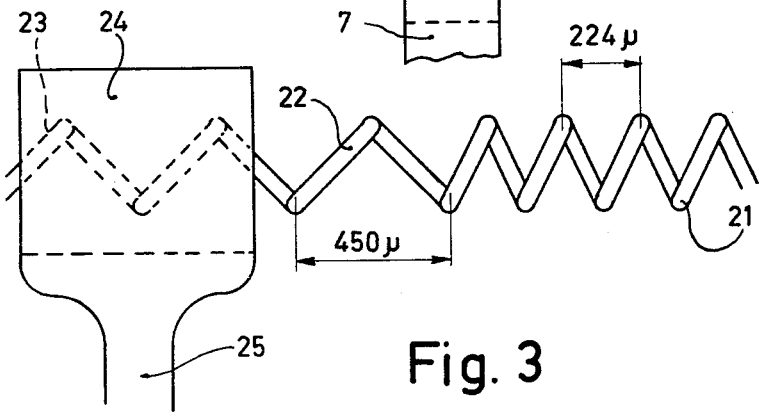

The invention will be described in greater detail with reference to the drawing, in which FIG. 1 shows an embodiment of the normal incandescent lamp according to the invention, FIG. 2 shows a detail of FIG. 1 on an enlarged scale, and FIG. 3 shows a detail of a filament which occurs in another embodiment of the normal incandescent lamp according to the invention.

As shown in FIG. 1, the normal incandescent lamp comprises a lamp envelope 1 and a lamp cap 2 which comprises a screw cap 3. A stem 4 having a bead 5 is present in the lamp envelope. In said bead 5 are secured current supply wires 6 and 7 and three supporting wires 8, 9 and 10. The free ends of the supporting wires have eyelets in which the coiled coil filament 11 is supported. The end portions 12 and 13 of the filament 11 are clamped in the bent ends 14 and 15 of the current supply wires 6 and 7, respectively.

The encircled part in FIG. 1 is shown on an enlarged scale in FIG. 2. The filament 11 of which only the secondary winding is shown consists in this embodiment of a central part 16 having a pitch of 224 $\mu$, two end portions 12 and 13 also having a pitch of 224 $\mu$ and two turns 20 having a pitch of 600 $\mu$. Each turn 20 lies in a zone of the filament which adjoins an end portion. It will be understood that the term "turn" as used herein relates to a 180° turn of a helix. The pitch of the secondary winding in the end portions 12 and 13 in this embodiment is thus equal to the pitch of the secondary winding in the central part 16.

The filament of the detail shown in FIG. 3 comprises a central portion 21 having a pitch of 224 $\mu$ bounded by a turn 22 and an end portion 23 each having a pitch of 450 $\mu$. The end portion 23 is clamped in the flattened bent end 24 of the current supply wire 25. So the pitch of the end portion 23 is equal to the pitch of the turn 22.

During operation of the normal incandescent lamp according to the invention, the temperature gradient over the turns 20 and 22, respectively, is large. Only the central portions 16 and 21, respectively, of the filament emit light, the end portions 12 and 13 and 23, respectively, have a lower temperature and emit no light. The number of turns contributing effectively to the luminous efficiency can be realized with great accuracy during winding the filament, while the connection of the filament to the current supply wires is rigid in this normal incandescent lamp.

What is claimed is:

1. An incandescent lamp which comprises a coiled coil filament disposed in a lamp envelope, said coiled coil having end portions, a central portion intermediate said end portions and first axial portions intermediate said central portion and each end portion, a first current supply wire, engaging one end portion of said filament and a second current supply wire engaging the other end portion of said filament, said first axial portions having at least one turn with a pitch larger than the pitch of said central portion, said central portion having substantially higher temperature during operation than said first axial portions and emitting substantially all of the light from said filament.

2. An incandescent lamp as claimed in claim 1, wherein the pitch of said end portions is no larger than said first axial portions and no smaller than the pitch of the central portion.

3. A normal incandescent lamp as claimed in claim 2, wherein the pitch of the winding in the first axial portions is at least 2 times and at most 4 times as large as the pitch of the winding in said central portion of the filament.

* * * * *